US010878738B1

(12) United States Patent
Ju

(10) Patent No.: US 10,878,738 B1
(45) Date of Patent: Dec. 29, 2020

(54) DISPLAY PRODUCT AND DRIVE CHIP FOR DRIVING DISPLAY PANEL

(71) Applicant: WUHAN CHINA STAR OPTOELECTRONICS SEMICONDUCTOR DISPLAY TECHNOLOGY CO., LTD., Hubei (CN)

(72) Inventor: Rui Ju, Hubei (CN)

(73) Assignee: WUHAN CHINA STAR OPTOELECTRONICS SEMICONDUCTOR DISPLAY TECHNOLOGY CO., LTD., Hubei (CN)

( * ) Notice: Subject to any disclaimer, the term of this patent is extended or adjusted under 35 U.S.C. 154(b) by 0 days.

(21) Appl. No.: 16/645,490

(22) PCT Filed: Nov. 5, 2019

(86) PCT No.: PCT/CN2019/115568
§ 371 (c)(1),
(2) Date: Mar. 9, 2020

(30) Foreign Application Priority Data

Jul. 30, 2019 (CN) ..... 2019 1 0696941

(51) Int. Cl.
*G09G 3/20* (2006.01)

(52) U.S. Cl.
CPC ..... *G09G 3/20* (2013.01); *G09G 2310/027* (2013.01); *G09G 2310/0291* (2013.01); *G09G 2320/0276* (2013.01)

(58) Field of Classification Search
None
See application file for complete search history.

(56) References Cited

U.S. PATENT DOCUMENTS

| | | | | |
|---|---|---|---|---|
| 8,884,677 | B1 | 11/2014 | Huang et al. | |
| 2002/0180717 | A1 | 12/2002 | Ishiyama | |
| 2006/0038764 | A1 | 2/2006 | Takahashi | |
| 2006/0267672 | A1 * | 11/2006 | Huang | G09G 3/2011 327/538 |

(Continued)

FOREIGN PATENT DOCUMENTS

| | | | |
|---|---|---|---|
| CN | 1389842 | A | 1/2003 |
| CN | 1737898 | A | 2/2006 |

(Continued)

*Primary Examiner* — Chad M Dicke
(74) *Attorney, Agent, or Firm* — Mark M. Friedman

(57) ABSTRACT

A display product and a drive chip for driving a display panel are provided. The drive chip includes a gamma voltage divider circuit, which includes a voltage-dividing resistor string, consisting of resistors connected in series, configured to generate binding-point grayscale voltages; OPs, each of which is disposed at an output channel of the binding-point grayscale voltage, each OP having a positive power end receiving a first voltage and a negative power end receiving a second voltage, the first voltage greater than the second voltage; a low-voltage stabilized supply, providing the fixed second voltage to the negative power end; and a DAC, providing the first voltage to the positive power end. The first voltage provided by the DAC is dynamically adjusted based on grayscale or data voltages that are to be inputted to the display panel. By this way, the power loss of the drive chip is reduced.

16 Claims, 4 Drawing Sheets

(56) References Cited

U.S. PATENT DOCUMENTS

| | | | |
|---|---|---|---|
| 2010/0245325 | A1 | 9/2010 | Xiao et al. |
| 2011/0175942 | A1 | 7/2011 | Ahn et al. |
| 2012/0019566 | A1 | 1/2012 | Ito |
| 2016/0086580 | A1 | 3/2016 | Wang et al. |
| 2017/0154592 | A1 | 6/2017 | Ji et al. |
| 2017/0178576 | A1 | 6/2017 | Zhu et al. |
| 2020/0162044 | A1 | 5/2020 | Tseng et al. |

FOREIGN PATENT DOCUMENTS

| | | | |
|---|---|---|---|
| CN | 1892789 | A | 1/2007 |
| CN | 101847378 | A | 9/2010 |
| CN | 102129847 | A | 7/2011 |
| CN | 102831864 | A | 12/2012 |
| CN | 103474019 | A | 12/2013 |
| CN | 104240665 | A | 12/2014 |
| CN | 104867469 | A | 8/2015 |
| CN | 108696251 | A | 10/2018 |
| CN | 109671406 | A | 4/2019 |

* cited by examiner

| b2 | b1 | b0 | Vout | Vop |
|---|---|---|---|---|
| 0 | 0 | 0 | V3<Vout≦V0 | GVDD |
| 0 | 0 | 1 | V7<Vout≦V3 | V0 |
| 0 | 1 | 0 | V13<Vout≦V7 | V3 |
| 0 | 1 | 1 | V24<Vout≦V13 | V7 |
| 1 | 0 | 0 | V36<Vout≦V24 | V13 |
| 1 | 0 | 1 | V55<Vout≦V36 | V24 |
| 1 | 1 | 0 | V155<Vout≦V55 | V36 |
| 1 | 1 | 1 | V255<Vout≦V155 | V55 |

DISPLAY PRODUCT AND DRIVE CHIP FOR DRIVING DISPLAY PANEL

FIELD OF THE DISCLOSURE

The present application relates to display technologies, and more particularly to a display product and a drive chip for driving a display panel.

DESCRIPTION OF RELATED ARTS

With rapid development of display technologies, active-matrix organic light-emitting diode (AMOLED) mobile phone products, and virtual reality (VR) and augmented reality (AR) products are accepted by more and more consumers. As the size of AMOLED display screens increases and mobile payment technologies and demands on entertainment and games grow, more and more people are inseparable from the use of these products. Demands on endurance of display products are higher and higher, especially portable display products (such as AMOLED products). Reducing the power consumption of display products is an important issue in the technical field.

Taking AMOLED mobile phones for example, a drive chip of an existing AMOLED display panel primary includes a source driving circuit, a gate driving circuit, a DC-DC module, a data processing module and a timing control module. The source driving circuit provides data signals to every subpixels in each column on the display panel. The source driving circuit includes a gamma voltage divider circuit which uses a voltage-dividing resistor string to provide a plurality of binding-point grayscale voltages. The binding-point grayscale voltage on each output channel is provided with an operational amplifier (OP). When applying grayscale voltages to pixels, the operational amplifier prevents a voltage drop caused by current supply, having a function of a voltage converter capable of performing impedance conversion.

FIG. 1 is a schematic diagram showing voltage deployment of an existing drive chip. In the existing drive chip, a system voltage VCI is boosted to obtain a boosted voltage AVDD, which is fed into the drive chip. A ground voltage GND is also provided to the drive chip. The boosted voltage AVDD is divided by voltage to obtain a high reference voltage GVDD, which is provided for the source driving circuit. A highest binding-point grayscale voltage GSP and a lowest binding-point grayscale voltage GSN that are provided by the gamma voltage divider circuit of the source driving circuit are obtained by dividing the high reference voltage GVDD by voltage.

In the existing art, the operational amplifier OP is disposed on each output channel of the binding-point grayscale voltages provided by the gamma voltage divider circuit. On each output channel, a positive input end of the operational amplifier OP receives the binding-point grayscale voltage Vgamma and a negative input end of the OP is connected to an output end of the OP. A positive power-supply end of the operational amplifier OP is fed by a voltage provided by the high reference voltage GVDD and a negative power-supply end of the OP is connected to the ground voltage GND.

In the existing gamma voltage divider circuit, the power supplied by the drive chip to the operational amplifier OP on each output channel is fixed. The operational amplifier OP itself will have power loss. If the voltage difference between a positive power supply and a negative power supply of the operational amplifier OP is large, the power loss will be large, too. However, the power supplied by the gamma voltage divider circuit to the operational amplifier OP on each channel is fixed. When outputting low grayscale voltages, power loss of corresponding operational amplifier OP will be more significant. This is because the data voltages outputted by the source driving circuit are low when a low grayscale image is displayed, and corresponding operational amplifier OP does not need a high power.

Therefore, how to reduce unnecessary power loss for the drive chip of the display panel is a technical problem needed to be solved in the field.

Technical Problems

The objective of the present application is to provide a display product and a drive chip for driving a display panel, for reducing power loss of the drive chip.

Technical Solutions

To achieve above objective, an aspect of the present application is to provide a drive chip for driving a display panel, the drive chip including a source driving circuit which includes a gamma voltage divider circuit for providing a plurality of binding-point grayscale voltages, the gamma voltage divider circuit including:

a voltage-dividing resistor string, consisting of a plurality of voltage-dividing resistors connected in series, configured to generate the plurality of binding-point grayscale voltages;

a plurality of operational amplifiers, each of which is disposed at an output channel of the binding-point grayscale voltage, each operational amplifier having a positive power-supply end receiving a first voltage and a negative power-supply end receiving a second voltage, wherein the first voltage is greater than the second voltage;

a low-voltage stabilized voltage supply, providing the second voltage, which is a fixed voltage, to the negative power-supply end of each operational amplifier; and a digital to analog converter (DAC), providing the first voltage to the positive power-supply end of each operational amplifier, wherein the first voltage provided by the DAC is dynamically adjusted based on grayscale or data voltages that are to be inputted to the display panel.

In an embodiment of the present application, the gamma voltage divider circuit further includes resistors configured to divide voltages between any two adjacent binding-point grayscale voltages to obtain grayscale voltages and the grayscale voltages correspond to the grayscale or data voltages that are to be inputted to the display panel.

In an embodiment of the present application, the operational amplifiers are disposed between the voltage-dividing resistors for generating the binding-point grayscale voltages and the resistors for generating the grayscale voltages.

In an embodiment of the present application, each operational amplifier further includes a positive input end, a negative input end and an output end, and the positive input end of the operational amplifier receives the binding-point grayscale voltage and the negative input end of the operational amplifier is electrically connected to the output end.

In an embodiment of the present application, the low-voltage stabilized voltage supply includes a low dropout (LDO) stabilized voltage supply.

In an embodiment of the present application, an input voltage of the low-voltage stabilized voltage supply is from a lowest binding-point grayscale voltage of the plurality of binding-point grayscale voltages and an output voltage of the low-voltage stabilized voltage supply is the second voltage, which is a fixed voltage, provided to the negative power-supply end of the operational amplifier.

In an embodiment of the present application, when the grayscale or data voltage that is to be inputted to the display panel is between a set of adjacent binding-point grayscale voltages, a voltage provided by the DAC to the positive power-supply end of the operational amplifier is a minimum of last set of adjacent binding-point grayscale voltages.

In an embodiment of the present application, the DAC receives the plurality of binding-point grayscale voltages at an input end of the DAC and outputs one of the plurality of binding-point grayscale voltages to the positive power-supply end of the operational amplifier.

In another aspect, the present application provides a display product, including a drive chip for driving a display panel, the drive chip including a source driving circuit which includes a gamma voltage divider circuit for providing a plurality of binding-point grayscale voltages, the gamma voltage divider circuit including:

a voltage-dividing resistor string, consisting of a plurality of voltage-dividing resistors connected in series, configured to generate the plurality of binding-point grayscale voltages;

a plurality of operational amplifiers, each of which is disposed at an output channel of the binding-point grayscale voltage, each operational amplifier having a positive power-supply end receiving a first voltage and a negative power-supply end receiving a second voltage, wherein the first voltage is greater than the second voltage;

a low-voltage stabilized voltage supply, providing the second voltage, which is a fixed voltage, to the negative power-supply end of each operational amplifier; and a digital to analog converter (DAC), providing the first voltage to the positive power-supply end of each operational amplifier, wherein the first voltage provided by the DAC is dynamically adjusted based on grayscale or data voltages that are to be inputted to the display panel.

In an embodiment of the present application, the gamma voltage divider circuit further includes resistors configured to divide voltages between any two adjacent binding-point grayscale voltages to obtain grayscale voltages and the grayscale voltages correspond to the grayscale or data voltages that are to be inputted to the display panel.

In an embodiment of the present application, the operational amplifiers are disposed between the voltage-dividing resistors for generating the binding-point grayscale voltages and the resistors for generating the grayscale voltages.

In an embodiment of the present application, each operational amplifier further includes a positive input end, a negative input end and an output end, and the positive input end of the operational amplifier receives the binding-point grayscale voltage and the negative input end of the operational amplifier is electrically connected to the output end.

In an embodiment of the present application, the low-voltage stabilized voltage supply includes a low dropout (LDO) stabilized voltage supply.

In an embodiment of the present application, an input voltage of the low-voltage stabilized voltage supply is from a lowest binding-point grayscale voltage of the plurality of binding-point grayscale voltages and an output voltage of the low-voltage stabilized voltage supply is the second voltage, which is a fixed voltage, provided to the negative power-supply end of the operational amplifier.

In an embodiment of the present application, when the grayscale or data voltage that is to be inputted to the display panel is between a set of adjacent binding-point grayscale voltages, a voltage provided by the DAC to the positive power-supply end of the operational amplifier is a minimum of last set of adjacent binding-point grayscale voltages.

In an embodiment of the present application, the DAC receives the plurality of binding-point grayscale voltages at an input end of the DAC and outputs one of the plurality of binding-point grayscale voltages to the positive power-supply end of the operational amplifier.

Beneficial Effects

In existing arts, the drive chip provides fixed power supply voltage to the operational amplifier on each output channel of the gamma voltage divider circuit and this causes the operational amplifier to have high power consumption such that power consumption of the drive chip is not good. Compared to the existing arts, the voltage difference between the positive power-supply end and the negative power-supply end of the operational amplifier on each output channel of the gamma voltage divider circuit of the drive chip of the present application is dynamically adjusted based on the data voltages that are to be inputted to the pixels. Accordingly, the power consumption of the operational amplifier can be effectively reduced, thereby improving the power consumption of the entire drive chip.

DESCRIPTION OF EMBODIMENTS OF THE DISCLOSURE

To make the objectives, technical schemes, and effects of the present application more clear and specific, the present application is described in further detail below with reference to the embodiments in accompanying with the appending drawings. It should be understood that the specific embodiments described herein are merely for explaining the present application, the term "embodiment" used in the context means an example, instance or illustration, and the present application is not limited thereto.

Figure 1:
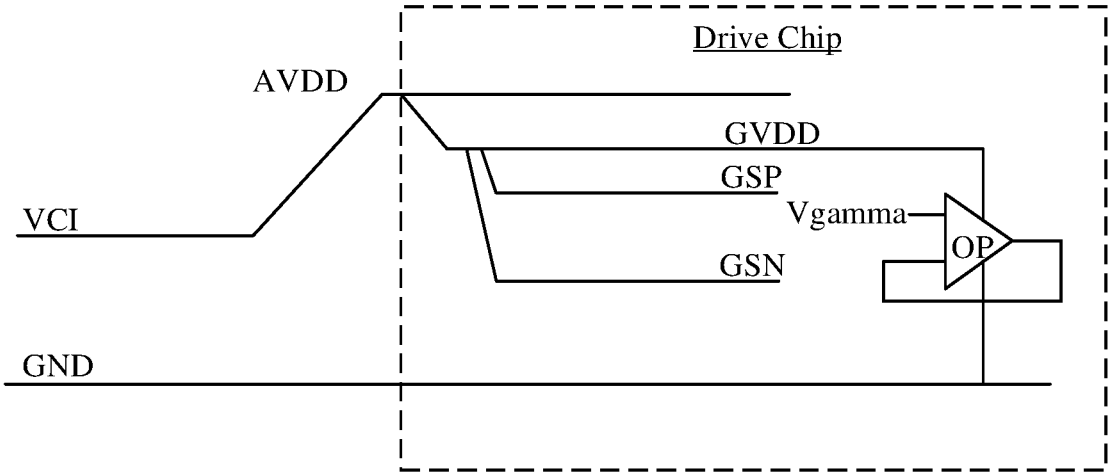
FIG. 1 is a schematic diagram showing voltage deployment of an existing drive chip.
Figure 2:
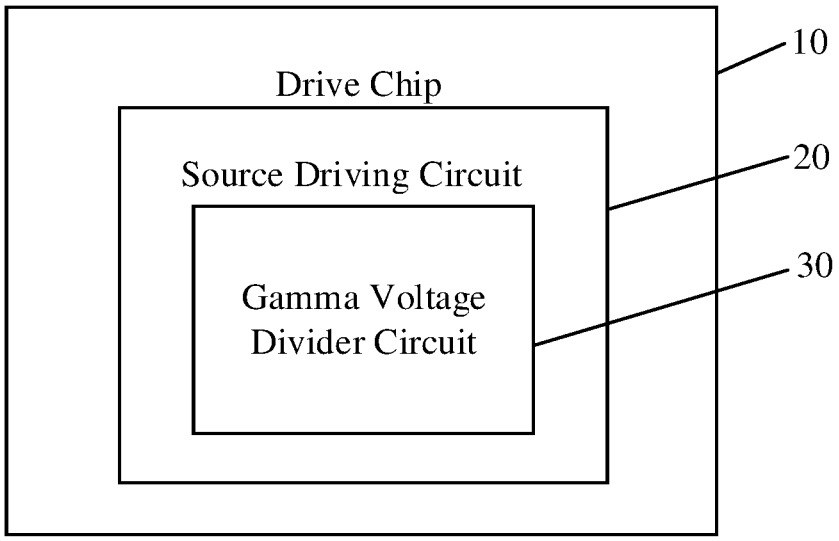
FIG. 2 is a schematic diagram showing a drive chip for driving a display panel according to the present application.
Figure 3:
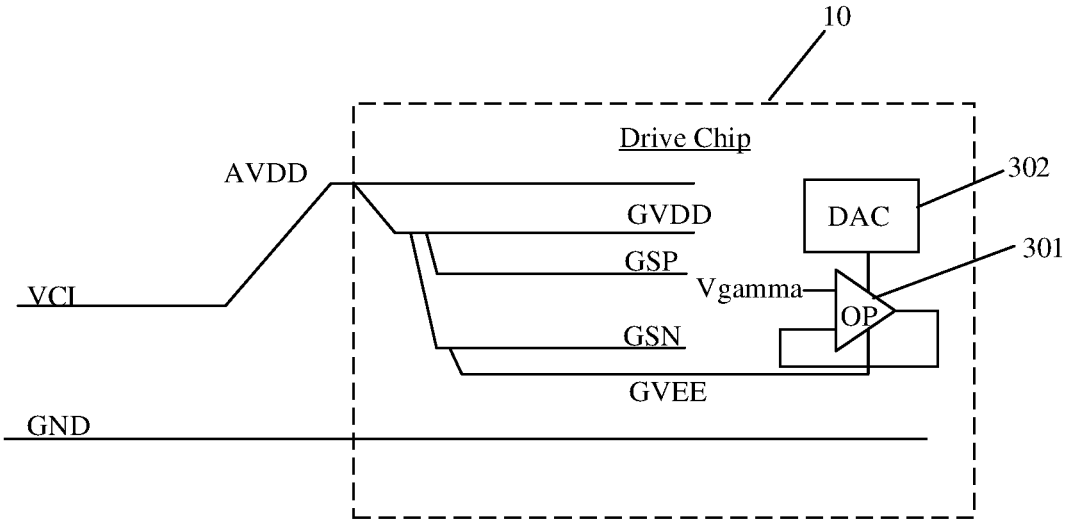
FIG. 3 is a schematic diagram showing voltage deployment of a drive chip according to the present application.
Figure 4:
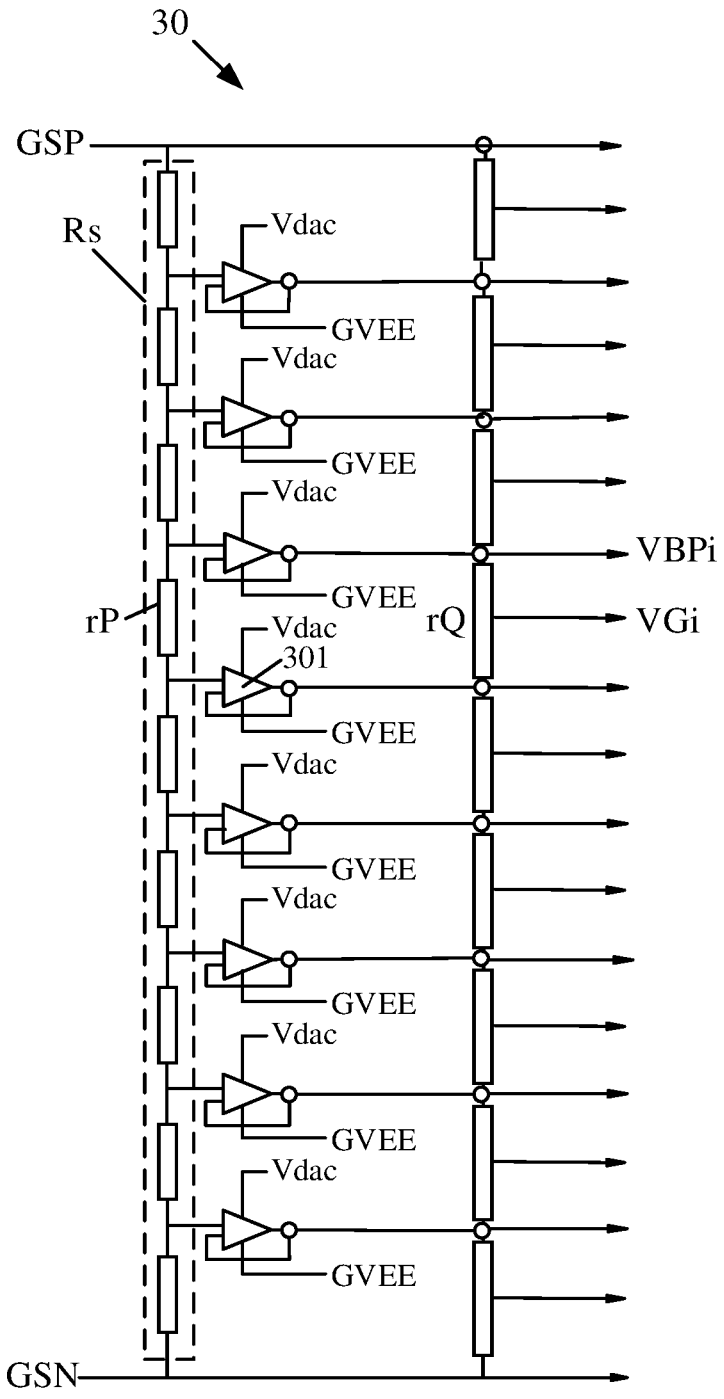
FIG. 4 is a schematic diagram showing a gamma voltage divider circuit according to the present application.

FIG. 2 is a schematic diagram showing a drive chip for driving a display panel according to the present application. FIG. 3 is a schematic diagram showing voltage deployment of a drive chip according to the present application. FIG. 4 is a schematic diagram showing a gamma voltage divider circuit according to the present application.

Referring to FIGS. 2 to 4, the drive chip 10 is configured to provide driving signals to a display panel for driving pixels on the display panel to generate grayscale brightness, thereby displaying images. The drive chip 10 of the present application is applicable to active-matrix display panels such as active-matrix liquid crystal display (AMLCD) panel and active-matrix organic light-emitting diode (AMOLED) display panels.

The drive chip 10 includes a gate driving circuit and a source driving circuit 20. The gate driving circuit provides scan signals to scan lines on the display panel for sequentially switching on thin-film transistors (TFTs) of the pixels. The source driving circuit 20 provides data signals to data lines on the display panel for sequentially inputting the data signals to the pixels, making the pixels illuminate at different levels. The drive chip 10 of the present application may only include the source driving circuit 20. The gate driving circuit is deployed in another drive chip.

The source driving circuit 20 includes a gamma voltage divider circuit 30 configured to provide a plurality of binding-point grayscale voltages by using a voltage-dividing resistor string. Voltages between any two adjacent binding-point grayscale voltages are divided by resistors to obtain grayscale voltages. The grayscale voltages correspond to data signals that are to be inputted to the pixels of the display panel. That is, the grayscale voltages make the pixels illuminate at different levels, resulting in grayscale brightness.

Pertaining to voltage deployment of the drive chip 10, the drive chip 10 receives a boosted voltage AVDD generated from a system voltage VCI. A ground voltage GND is also provided to the drive chip 10. The boosted voltage AVDD are divided by voltage to obtain a high reference voltage GVDD provided for the source driving circuit 20. A highest binding-point grayscale voltage GSP and a lowest binding-point grayscale voltage GSN that are provided by the gamma voltage divider circuit 30 of the source driving circuit 20 are obtained by dividing the high reference voltage GVDD by voltage.

The GSP voltage and the GSN voltage are inputted to the source driving circuit. The GSP voltage serves as the highest binding-point grayscale voltage and the GSN voltage serves as the lowest binding-point grayscale voltage. The gamma voltage divider circuit 30 includes a voltage-dividing resistor string Rs consisting of a plurality of voltage-dividing resistors rP connected in series. One end of the voltage-dividing resistor string Rs is inputted with the GSP voltage and the other end of the voltage-dividing resistor string Rs is inputted with the GSN voltage. By the voltage-dividing resistor string Rs, the gamma voltage divider circuit 30 generates a plurality of binding-point grayscale voltage VBPi between the highest binding-point grayscale voltage GSP and the lowest binding-point grayscale voltage GSN. Voltages between any two adjacent binding-point grayscale voltages are divided by resisters rQ to generate grayscale voltages VGi. The gamma voltage divider circuit 30 has a function of a multivalued voltage producing circuit. Based on a gray level represented by display data, the source driving circuit 20 selects one of the grayscale voltage VGi and applies the same to the pixel.

The resistor string (i.e., the voltage-dividing resistor string Rs) consisting of the voltage-dividing resistors rP for generating the binding-point grayscale voltages VBPi is deployed at an input end of the gamma voltage divider circuit 30. The resistor string consisting of the resistors rQ for generating the grayscale voltages VGi is deployed at an output end of the gamma voltage divider circuit 30. The voltage-dividing resistors rP are variable resistors, for example. The resistors rQ are fixed resistors, for example. The resistance of the voltage-dividing resistors rP can be calibrated by correcting signals to achieve gamma correction.

The gamma voltage divider circuit 30 includes a plurality of operational amplifiers (OPs) 301. Each operational amplifier 301 is disposed at an output channel of the binding-point grayscale voltage VBPi. That is, there is one operational amplifier 301 disposed at each output channel of the binding-point grayscale voltages VBPi. Specifically, the operational amplifiers 301 are disposed between the voltage-dividing resistors rP for generating the binding-point grayscale voltages VBPi and the resistors rQ for generating grayscale voltages VGi.

The operational amplifier 301 has a positive input end, a negative input end, an output end, a positive power-supply end and a negative power-supply end. The positive input end of the operational amplifier 301 receives a gamma voltage Vgamma (i.e., the binding-point grayscale voltage VBPi) and the negative input end is connected to the output end. When applying the grayscale voltages to the pixels, the operational amplifier 301 prevents a voltage drop caused by current supply, having a function of a voltage converter capable of performing impedance conversion.

The gamma voltage divider circuit 30 further includes a low-voltage stabilized voltage supply GVEE and a digital to analog converter (DAC) 302. On each output channel of the binding-point grayscale voltages VBPi, the positive power-supply end of the operational amplifier 301 receives a voltage provided by the DAC 302 and the negative power-supply end of the operational amplifier 301 receives a voltage provided by the low-voltage stabilized voltage supply GVEE. That is, the operational amplifier 301 on each output channel of the binding-point grayscale voltages VBPi uses dual power supply.

The low-voltage stabilized voltage supply GVEE is configured to provide a stabilized low voltage to the operational amplifier 301. The DAC 302 will dynamically adjust a voltage that is to be provided to the positive power-supply end of the operational amplifier 301, based on data voltages (or data signals) that are to be inputted the pixels. Since a voltage difference supplied to the positive power-supply end and the negative power-supply end of the operational amplifier 301 is dynamically adjusted based on the data voltages that are to be inputted to the pixels, power consumption of the operational amplifier 301 can be reduced, thereby reducing the overall power consumption of the drive chip.

The low-voltage stabilized voltage supply GVEE can be implemented by a low dropout (LDO) voltage stabilized circuit. The LDO voltage stabilized circuit is a well-operated voltage stabilized circuit even though a voltage difference between the input and the output is low. As shown in FIG. 4, the input voltage of the LDO voltage stabilized circuit can be from the lowest binding-point grayscale voltage GSN of the gamma voltage divider circuit 30. The smaller the voltage difference between the input voltage (i.e., the lowest binding-point grayscale voltage GSN) of the LDO voltage stabilized circuit and the output voltage (i.e., the low-voltage stabilized voltage supply GVEE) of the LDO voltage stabilized circuit, the fewer the power loss of the LDO voltage stabilized circuit. Accordingly, the magnitude of the GVEE voltage is preferred to be close to the GSN voltage as much as possible. The two voltages should not differ from each other too much (their difference is preferred to be 0.3V).

Based on the data voltages that are to be inputted to the pixels, the DAC 302 outputs a voltage Vdac to the positive power-supply end of the operational amplifier 301. The DAC 302 can produce an appropriate output voltage Vdac to the operational amplifier 301 based on the needed grayscale or data voltages, for reducing the power loss of the operational amplifier 301 itself. Specifically, in an embodiment, when a data voltage needed to be inputted to the pixel is between a set of adjacent binding-point grayscale voltages (e.g., VBP4 and VBP3), the output voltage Vdac of the DAC 302 is a minimum binding-point grayscale voltage (VBP2) of the last set of adjacent binding-point grayscale voltages (e.g., VBP3 and VBP2).

Figures 5, 6:
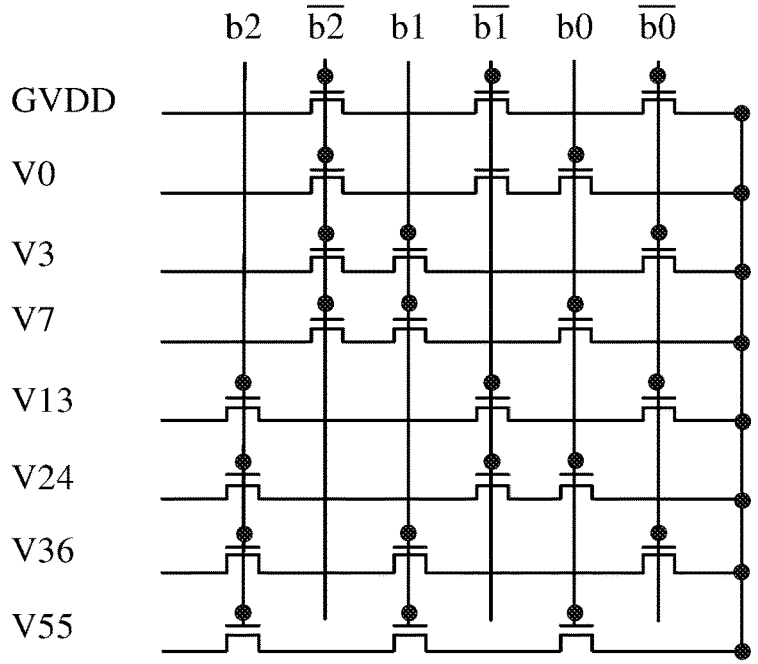
FIG. 5 is a diagram illustrating principles of a 3-bit DAC according to the present application.
FIG. 6 is a truth table for a DAC according to the present application.

FIG. 5 is a diagram illustrating principles of a 3-bit DAC according to the present application. FIG. 6 is a truth table for a DAC according to the present application. Referring to FIGS. 5 and 6, a 3-bit DAC is utilized for the following description. V0, V3, V7, V13, V24, V36 and V55 indicate the binding-point grayscale voltages (i.e., VBPi). Each of b2, b1 and b0 indicates a digit of a 3-bit value. Vout indicates a grayscale or data voltage that is to be inputted to the pixel. Vop indicates the output voltage Vdac of the DAC 302, that is, a voltage provided to the positive power-supply end of the operational amplifier 301. Assuming that a data voltage Vout that is to be inputted to the pixel is a grayscale voltage value 48, it can be known from the table shown in FIG. 6 that grayscale 48 falls within a range of grayscale 55 to grayscale 36. Meanwhile, by utilizing a micro control unit (MCU), a 3-bit value "101" can be inputted to the DAC 302, and thus the DAC 302 outputs a binding-point grayscale voltage V24 to the positive power-supply end of the operational amplifier 301. In another example, assuming that a data voltage Vout that is to be inputted to the pixel is a grayscale voltage value 30, it can be known from the table shown in FIG. 6 that grayscale 30 falls within a range of grayscale 36 to grayscale 24. Meanwhile, by utilizing a micro control unit (MCU), a 3-bit value "100" can be inputted to the DAC 302, and thus the DAC 302 outputs a binding-point grayscale voltage V13 to the positive power-supply end of the operational amplifier 301. By this way, dynamically adjusting the voltage outputted to the positive power-supply end of the operational amplifier 301 by the DAC 302 can be achieved. The input end of the DAC 302 can receive the binding-point grayscale voltage VBPi on each channel of the gamma voltage divider circuit 30 and output the binding-point grayscale voltage VBPi on one of the channels to the positive power-supply end of the operational amplifier 301.

The present application further provides a display product which includes the afore-described drive chip. The details of the drive chip are referred to above context, and are not repeated herein.

In existing arts, the drive chip provides fixed power supply voltage to the operational amplifier on each output channel of the gamma voltage divider circuit and this causes the operational amplifier to have high power consumption such that power consumption of the drive chip is not good. Compared to the existing arts, the voltage difference between the positive power-supply end and the negative power-supply end of the operational amplifier on each output channel of the gamma voltage divider circuit of the drive chip of the present application is dynamically adjusted based on the data voltages that are to be inputted to the pixels. Accordingly, the power consumption of the operational amplifier can be effectively reduced, thereby improving the power consumption of the entire drive chip.

While the preferred embodiments of the present application have been illustrated and described in detail, various modifications and alterations can be made by persons skilled in this art. The embodiment of the present application is therefore described in an illustrative but not restrictive sense. It is intended that the present application should not be limited to the particular forms as illustrated, and that all modifications and alterations which maintain the realm of the present application are within the scope as defined in the appended claims.

The invention claimed is:

1. A drive chip for driving a display panel, the drive chip comprising a source driving circuit which comprises a gamma voltage divider circuit for providing a plurality of binding-point grayscale voltages, the gamma voltage divider circuit comprising:

a voltage-dividing resistor string, consisting of a plurality of voltage-dividing resistors connected in series, configured to generate the plurality of binding-point grayscale voltages;

a plurality of operational amplifiers, each of which is disposed at an output channel of the binding-point grayscale voltage, each operational amplifier having a positive power-supply end receiving a first voltage and a negative power-supply end receiving a second voltage, wherein the first voltage is greater than the second voltage;

a low-voltage stabilized voltage supply, providing the second voltage, which is a fixed voltage, to the negative power-supply end of each operational amplifier; and a digital to analog converter (DAC), providing the first voltage to the positive power-supply end of each operational amplifier, wherein the first voltage provided by the DAC is dynamically adjusted based on grayscale or data voltages that are to be inputted to the display panel.

2. The drive chip according to claim 1, wherein the gamma voltage divider circuit further comprises resistors configured to divide voltages between any two adjacent binding-point grayscale voltages to obtain grayscale voltages and the grayscale voltages correspond to the grayscale or data voltages that are to be inputted to the display panel.

3. The drive chip according to claim 2, wherein the operational amplifiers are disposed between the voltage-dividing resistors for generating the binding-point grayscale voltages and the resistors for generating the grayscale voltages.

4. The drive chip according to claim 1, wherein each operational amplifier further comprises a positive input end, a negative input end and an output end, and the positive input end of the operational amplifier receives the binding-point grayscale voltage and the negative input end of the operational amplifier is electrically connected to the output end.

5. The drive chip according to claim 1, wherein the low-voltage stabilized voltage supply comprises a low drop-out (LDO) stabilized voltage supply.

6. The drive chip according to claim 1, wherein an input voltage of the low-voltage stabilized voltage supply is from a lowest binding-point grayscale voltage of the plurality of binding-point grayscale voltages and an output voltage of the low-voltage stabilized voltage supply is the second voltage, which is a fixed voltage, provided to the negative power-supply end of the operational amplifier.

7. The drive chip according to claim 1, wherein when the grayscale or data voltage that is to be inputted to the display panel is between a set of adjacent binding-point grayscale voltages, a voltage provided by the DAC to the positive power-supply end of the operational amplifier is a minimum of last set of adjacent binding-point grayscale voltages.

8. The drive chip according to claim 1, wherein the DAC receives the plurality of binding-point grayscale voltages at an input end of the DAC and outputs one of the plurality of binding-point grayscale voltages to the positive power-supply end of the operational amplifier.

9. A display product, comprising a drive chip for driving a display panel, the drive chip comprising a source driving circuit which comprises a gamma voltage divider circuit for providing a plurality of binding-point grayscale voltages, the gamma voltage divider circuit comprising:

a voltage-dividing resistor string, consisting of a plurality of voltage-dividing resistors connected in series, configured to generate the plurality of binding-point grayscale voltages;

a plurality of operational amplifiers, each of which is disposed at an output channel of the binding-point grayscale voltage, each operational amplifier having a positive power-supply end receiving a first voltage and a negative power-supply end receiving a second voltage, wherein the first voltage is greater than the second voltage;

a low-voltage stabilized voltage supply, providing the second voltage, which is a fixed voltage, to the negative power-supply end of each operational amplifier; and a digital to analog converter (DAC), providing the first voltage to the positive power-supply end of each operational amplifier, wherein the first voltage provided by the DAC is dynamically adjusted based on grayscale or data voltages that are to be inputted to the display panel.

10. The display product according to claim 9, wherein the gamma voltage divider circuit further comprises resistors configured to divide voltages between any two adjacent binding-point grayscale voltages to obtain grayscale voltages and the grayscale voltages correspond to the grayscale or data voltages that are to be inputted to the display panel.

11. The display product according to claim 10, wherein the operational amplifiers are disposed between the voltage-dividing resistors for generating the binding-point grayscale voltages and the resistors for generating the grayscale voltages.

12. The display product according to claim 9, wherein each operational amplifier further comprises a positive input end, a negative input end and an output end, and the positive input end of the operational amplifier receives the binding-point grayscale voltage and the negative input end of the operational amplifier is electrically connected to the output end.

13. The display product according to claim 9, wherein the low-voltage stabilized voltage supply comprises a low drop-out (LDO) stabilized voltage supply.

14. The display product according to claim 9, wherein an input voltage of the low-voltage stabilized voltage supply is from a lowest binding-point grayscale voltage of the plurality of binding-point grayscale voltages and an output voltage of the low-voltage stabilized voltage supply is the second voltage, which is a fixed voltage, provided to the negative power-supply end of the operational amplifier.

15. The display product according to claim 9, wherein when the grayscale or data voltage that is to be inputted to the display panel is between a set of adjacent binding-point grayscale voltages, a voltage provided by the DAC to the positive power-supply end of the operational amplifier is a minimum of last set of adjacent binding-point grayscale voltages.

16. The display product according to claim 9, wherein the DAC receives the plurality of binding-point grayscale voltages at an input end of the DAC and outputs one of the plurality of binding-point grayscale voltages to the positive power-supply end of the operational amplifier.

* * * * *